US009396855B2

(12) United States Patent
Tamura

(10) Patent No.: US 9,396,855 B2
(45) Date of Patent: Jul. 19, 2016

(54) METHOD FOR COOLING A SUPERCONDUCTING MAGNET AND THE SUPERCONDUCTING MAGNET

(71) Applicant: Hajime Tamura, Tokyo (JP)

(72) Inventor: Hajime Tamura, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 14/649,719

(22) PCT Filed: Mar. 18, 2013

(86) PCT No.: PCT/JP2013/057607

§ 371 (c)(1),
(2) Date: Jun. 4, 2015

(87) PCT Pub. No.: WO2014/147698

PCT Pub. Date: Sep. 25, 2014

(65) Prior Publication Data

US 2015/0380137 A1 Dec. 31, 2015

(51) Int. Cl.

| | |
|---|---|
| ***H01F 6/04*** | (2006.01) |
| ***H01F 6/00*** | (2006.01) |
| ***F25D 19/00*** | (2006.01) |

(52) U.S. Cl.

CPC ..... *H01F 6/04* (2013.01); *F25D 19/006* (2013.01); *H01F 6/00* (2013.01)

(58) Field of Classification Search

CPC ..... H01F 6/00; H01F 6/04; F25D 9/006
See application file for complete search history.

(56) References Cited

U.S. PATENT DOCUMENTS

| | | | | |
|---|---|---|---|---|
| 5,111,665 A * | 5/1992 | Ackermann | ..... | F25D 19/006 505/894 |
| 6,438,967 B1 * | 8/2002 | Sarwinski | ..... | F25D 19/006 165/185 |

FOREIGN PATENT DOCUMENTS

| | | | |
|---|---|---|---|
| JP | 64-028904 | A | 1/1989 |
| JP | 1-149406 | A | 6/1989 |
| JP | 9-287838 | A | 11/1997 |
| JP | 2006-352150 | A | 12/2006 |
| JP | 2009-032758 | A | 2/2009 |
| JP | 2011-253873 | A | 12/2011 |

OTHER PUBLICATIONS

International Search Report (PCT/ISA/210) mailed on Jun. 18, 2013, by the Japanese Patent Office as the International Searching Authority for International Application No. PCT/JP2013/057607.

* cited by examiner

*Primary Examiner* — Mohamad Musleh
(74) *Attorney, Agent, or Firm* — Buchanan Ingersoll & Rooney PC

(57) ABSTRACT

A method includes the steps of: bringing a refrigerator's distal end into contact with a contact of a heat transfer member to thermally connect the refrigerator via the heat transfer member to a superconducting coil to cool the superconducting coil to cryogenic temperature; after the step of bringing the refrigerator's distal end into contact with the contact of the heat transfer member, bringing the refrigerator's distal end out of contact with the contact of the heat transfer member; and after the step of bringing the refrigerator's distal end out of contact with the contact of the heat transfer member, injecting liquid helium into a helium tank.

6 Claims, 7 Drawing Sheets

METHOD FOR COOLING A SUPERCONDUCTING MAGNET AND THE SUPERCONDUCTING MAGNET

TECHNICAL FIELD

The present invention relates to a method for cooling a superconducting magnet and the superconducting magnet.

BACKGROUND ART

Japanese Patent Laying-Open No. 2009-32758 (PTD 1) is a prior art document disclosing a configuration of a conduction-cooled superconducting magnet device with a superconducting coil less quenchable despite power failure.

The conduction-cooled superconducting magnet device described in PTD 1 includes a cryogenic refrigerator, a tank having a refrigerant therein, a superconducting coil immersed in the refrigerant, and a heat transfer means in thermal contact with both the tank and the cryogenic refrigerator for allowing thermal conduction therebetween.

When the conduction-cooled superconducting magnet device has the cryogenic refrigerator in operation, it is adapted to allow the thermal conduction between the tank and the cryogenic refrigerator via the heat transfer means to cool the tank. Once the cryogenic refrigerator has stopped from operating, an interruption means that is provided for the heat transfer means interrupts the thermal conduction between the tank and the cryogenic refrigerator to prevent the heat transfer means from letting external heat enter the tank and thus vaporize the refrigerant.

CITATION LIST

Patent Document

PTD 1: Japanese Patent Laying-Open No. 2009-032758

SUMMARY OF INVENTION

Technical Problem

While PTD 1 describes the heat transfer means in thermal contact with both the superconducting coil and the refrigerator for allowing thermal conduction therebetween and the interruption means provided for the heat transfer means to interrupt the thermal conduction between the superconducting coil and the refrigerator, the document is silent on how they are specifically configured.

Furthermore, if a heat transfer switch which is a movable member is provided in a helium tank, the heat transfer switch may be frozen and not operate, and cannot reliably interrupt thermal conduction between the superconducting coil and the refrigerator.

The present invention has been made in view of the above issue and contemplates a method for cooling a superconducting magnet and the superconducting magnet, that can reliably prevent heat intrusion through a refrigerator when the refrigerator is not in operation.

Solution to Problem

The present invention provides a method for cooling a superconducting magnet including: a helium tank provided to store liquid helium therein; a superconducting coil accommodated in the helium tank and immersed in the liquid helium; a vacuum vessel having the helium tank accommodated therein; a refrigerator detachably secured to the vacuum vessel and having a distal end in the helium tank; and a heat transfer member located in the helium tank and thermally connected to the superconducting coil in contact therewith, and having a contact allowed to contact the distal end of the refrigerator. The method for cooling the superconducting magnet includes the steps of: bringing the refrigerator's distal end into contact with the contact of the heat transfer member to thermally connect the refrigerator via the heat transfer member to the superconducting coil to cool the superconducting coil to cryogenic temperature; after the step of bringing the refrigerator's distal end into contact with the contact of the heat transfer member, bringing the refrigerator's distal end out of contact with the contact of the heat transfer member; and after the step of bringing the refrigerator's distal end out of contact with the contact of the heat transfer member, injecting the liquid helium into the helium tank.

Advantageous Effect of Invention

The present invention can thus reliably prevent heat intrusion through a refrigerator when the refrigerator is not in operation.

DESCRIPTION OF EMBODIMENTS

Hereafter, reference will be made to the drawings to describe a method for cooling a superconducting magnet and the superconducting magnet according to a first embodiment of the present invention. In describing the following embodiments, identical or corresponding components are identically denoted and will not be described repeatedly in detail.

First Embodiment

Figure 1:
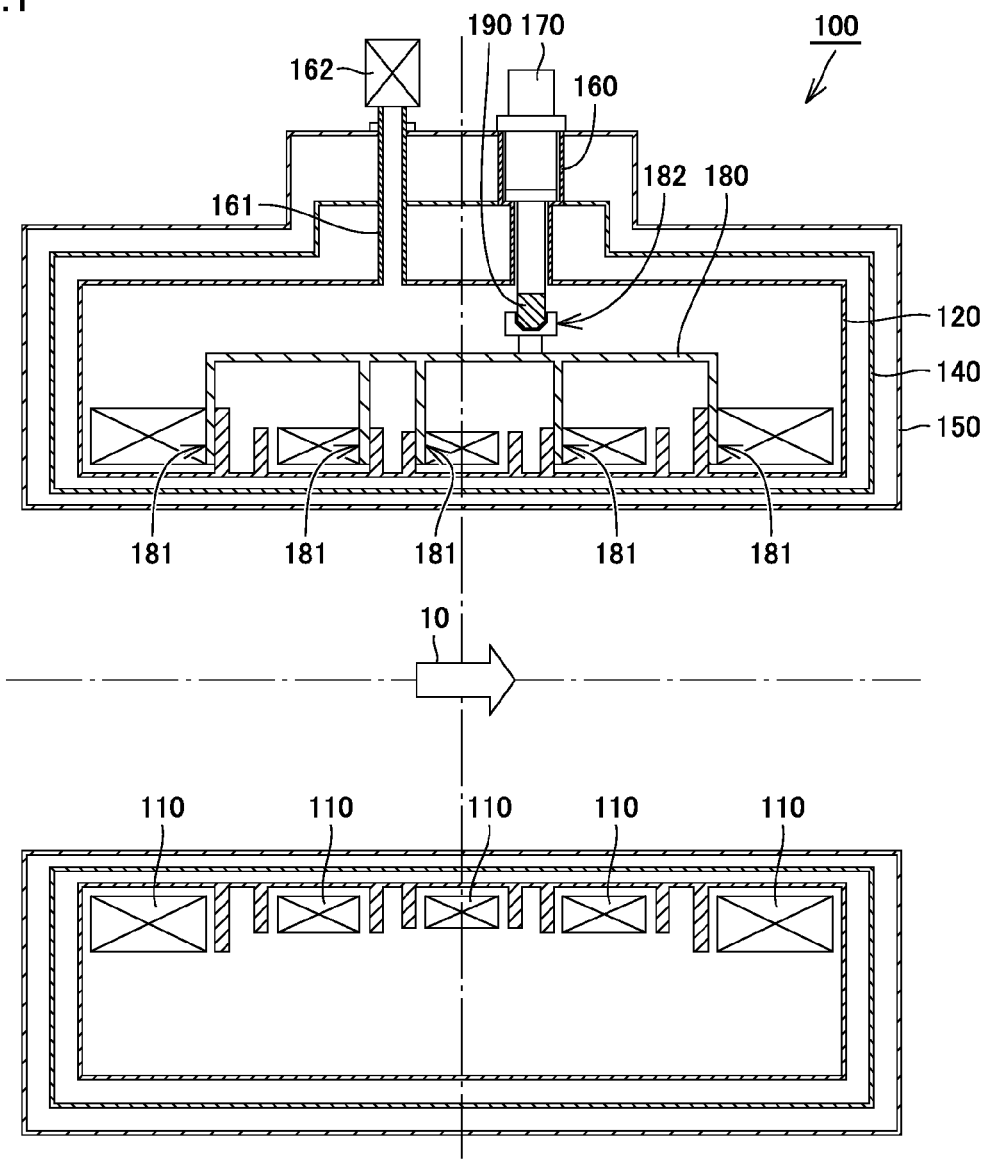
FIG. 1 shows in cross section a superconducting magnet according to a first embodiment of the present invention when it has a superconducting coil cooled to cryogenic temperature.
Figure 2:
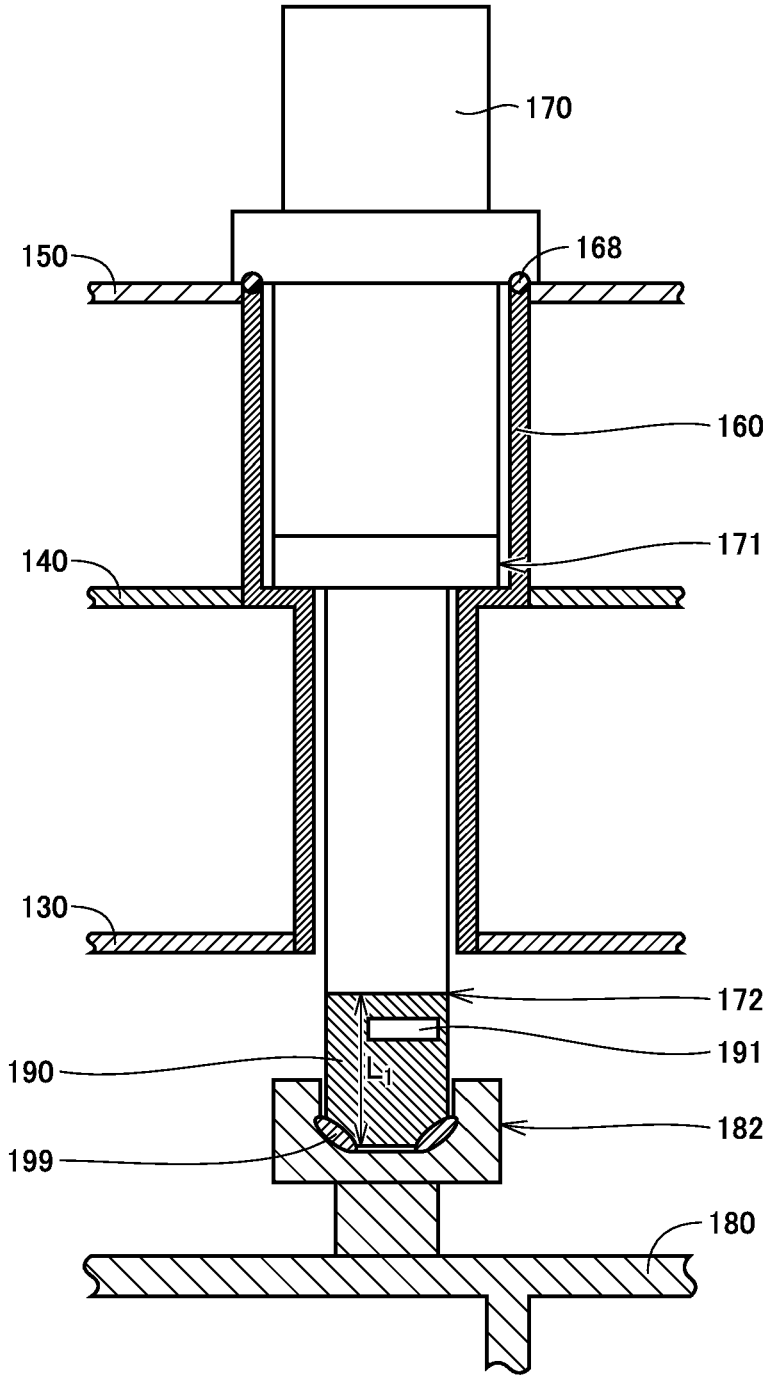
FIG. 2 shows in cross section a refrigerator in the state of FIG. 1 in an enlarged view.

FIG. 1 shows in cross section a superconducting magnet according to a first embodiment of the present invention when it has a superconducting coil cooled to cryogenic temperature. FIG. 2 shows in cross section a refrigerator in the state of FIG. 1 in an enlarged view. Note that FIG. 1 does not show an expansion member. Furthermore, FIG. 2 shows the expansion member unexpanded.

Figure 3:
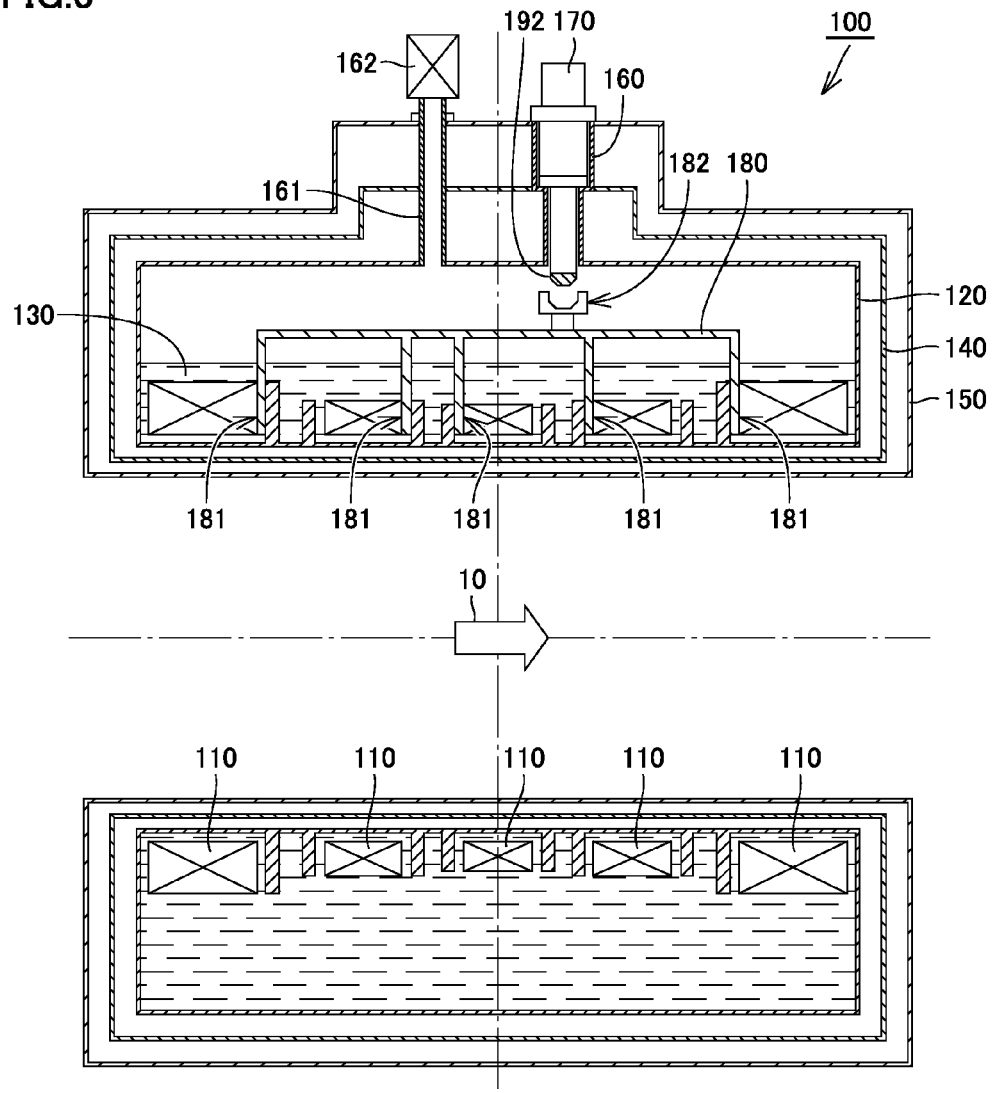
FIG. 3 shows in cross section the superconducting magnet according to the same embodiment when the superconducting coil has been cooled by the refrigerator and liquid helium is injected.
Figure 4:
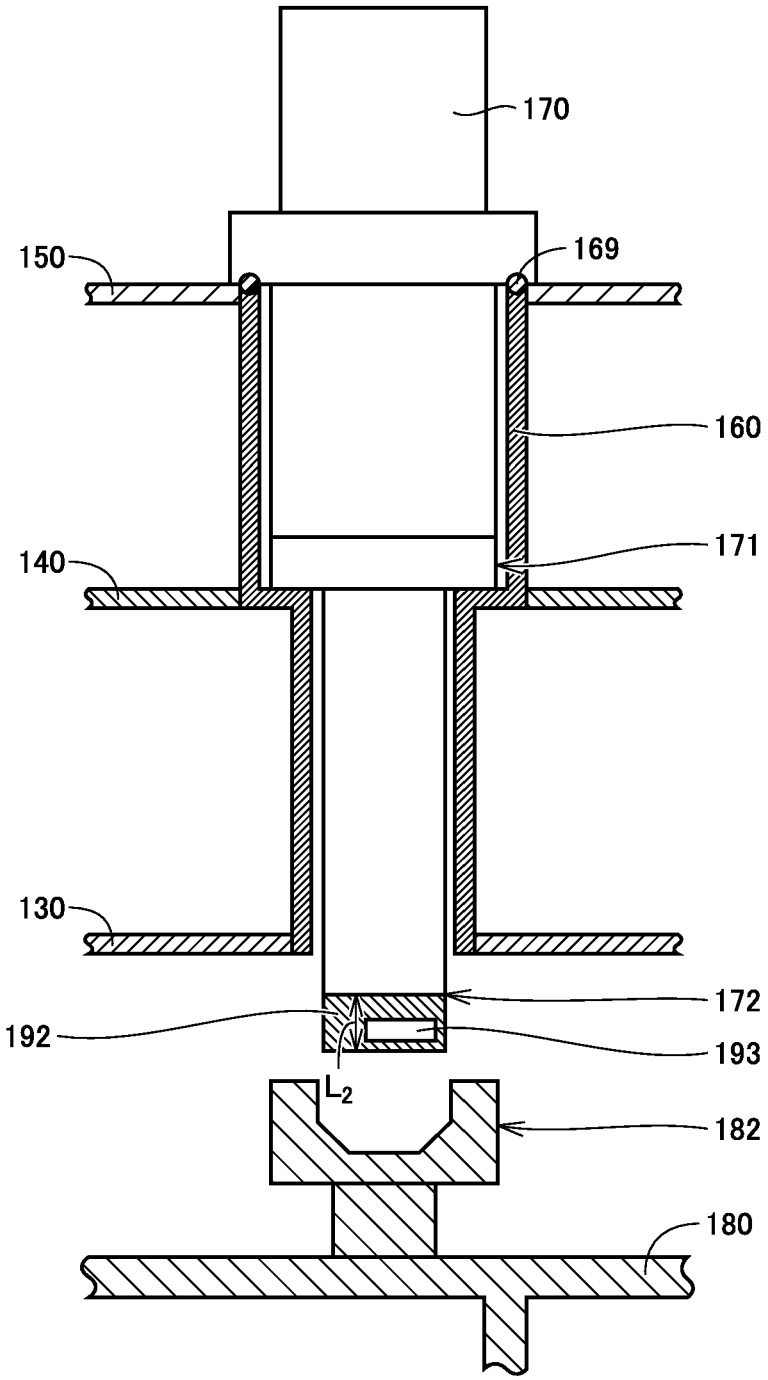
FIG. 4 shows in cross section the refrigerator in the state of FIG. 3 in an enlarged view.

FIG. 3 shows in cross section the superconducting magnet according to the present embodiment when the superconducting coil has been cooled by the refrigerator and liquid helium is injected. FIG. 4 shows in cross section the refrigerator in the state of FIG. 3 in an enlarged view.

As shown in FIG. 1 to FIG. 4, the present invention in the first embodiment provides a superconducting magnet 100 including a helium tank 120 provided to store liquid helium 130 therein, a superconducting coil 110 accommodated in helium tank 120 and immersed in liquid helium 130, and a vacuum vessel 150 having helium tank 120 accommodated therein. In the present embodiment, a heat shield 140 is disposed between helium tank 120 and vacuum vessel 150.

Furthermore, superconducting magnet 100 includes: a cylindrical portion 160 extending from vacuum vessel 150 to helium tank 120 to allow communication between the outside of vacuum vessel 150 and the interior of helium tank 120; a refrigerator inserted in cylindrical portion 160 and detachably secured to vacuum vessel 150, and having a distal end in helium tank 120; and a heat transfer member 180 located in helium tank 120 and thermally connected to superconducting coil 110 in contact therewith. Heat transfer member 180 has a contact 182 located under cylindrical portion 160 and allowed to contact the distal end of the refrigerator.

Superconducting magnet 100 is configured, as will be described hereafter more specifically.

Superconducting coil 110 is made of a superconducting wire of a niobium titanium alloy wound in helium tank 120 on a bottom surface thereof in the form of a solenoid. Note that the superconducting wire is not limited in material to the niobium titanium alloy, and may for example be a niobium tin alloy. Superconducting magnet 100 has a plurality of superconducting coils 110. When a current received from an external power supply (not shown) passes through superconducting coil 110, a magnetic field is generated in an area in a direction indicated by an arrow 10.

Helium tank 120 is formed of stainless steel and is generally annular in geometry in a side view. Note that helium tank 120 is not limited in material to stainless steel, and may be of any material having large rigidity.

As has been described above, helium tank 120 has a function as a spool for superconducting coil 110. Superconducting coil 110 experiences large electromagnetic force. Accordingly, helium tank 120 is required to have large rigidity to be capable of securing superconducting coil 110 at a prescribed position against the electromagnetic force acting on superconducting coil 110.

Furthermore, helium tank 120 has an upper portion with a piping 161 connected thereto for supplying helium tank 120 with helium. Piping 161 has a proximal end outside vacuum vessel 150. Piping 161 has the proximal end with a valve 162 provided for opening/closing piping 161.

Heat shield 140 is generally annular in a side view and surrounds helium tank 120 as seen in cross section. Heat shield 140 prevents helium tank 120 from having external heat intrusion through thermal radiation. While heat shield 140 is formed of aluminum, heat shield 140 is not limited in material thereto and may be of any material having high thermal conductivity.

Vacuum vessel 150 has superconducting coil 110, helium tank 120, and heat shield 140 accommodated therein. Vacuum vessel 150 has its interior and exterior vacuum-insulated. Vacuum vessel 150 in a side view is generally annular in geometry.

Helium tank 120, heat shield 140, and vacuum vessel 150 together configure a cryostat that is a structure that reduces/prevents heat intrusion into superconducting coil 110. In the present embodiment when the cryostat has an internal temperature of 4 K it has heat intrusion in an amount of 0.6 W.

As has been described above, the cryostat is provided with cylindrical portion 160 for attaching the refrigerator. Cylindrical portion 160 has an upper end connected to an open end of vacuum vessel 150, and a lower end connected to an open end of helium tank 120.

In the present embodiment, superconducting magnet 100 has heat transfer member 180 having contact 182 located immediately under the lower end of cylindrical portion 160. Heat transfer member 180 has a plurality of connections 181 thermally connected to a plurality of superconducting coils 110, respectively, in contact therewith. Note, however, that heat transfer member 180 is in contact with each superconducting coil 110 with an insulating paper interposed and is thus electrically insulated therefrom. Heat transfer member 180 is formed of copper. Note that heat transfer member 180 is not limited in material to copper, and may be of any material having large thermal conductivity.

In the present embodiment, heat transfer member 180 has contact 182 shaped to be fittable to the distal end of the refrigerator. Specifically, contact 182 has a recess slightly larger in geometry than the distal end of the refrigerator. Note that contact 182 is not limited in geometry as described above, and may be of any geometry allowing it to contact the distal end of the refrigerator.

In the present embodiment, the refrigerator includes a refrigerator body 170 thereof and an extension member attached to a distal end of refrigerator body 170. Refrigerator body 170 is a Gifford-McMahon (GM) refrigerator. Refrigerator body 170 has a refrigeration capacity of 1 W for a temperature of 4 K and thus has a refrigeration capacity sufficient for the amount of heat intrusion into the cryostat (i.e., 0.6 W). Note that the refrigerator is not limited in type to the GM refrigerator and may be any other type of refrigerator such as a pulse tube refrigerator.

Refrigerator body 170 has two cooling stages. A first cooling stage 171 is in contact with heat shield 140. A second cooling stage 172 is connected to the extension member. Second cooling stage 172 and the extension member are cylinders having substantially equal diameters, respectively. While the extension member is formed of copper, the extension member is not limited in material thereto and may be of any material having high thermal conductivity.

In the present embodiment, two extension members different in length are selectively used. Specifically, when superconducting coil 110 is cooled to cryogenic temperature, a long extension member 190 shown in FIG. 2 is used, and once superconducting coil 110 has been cooled by the refrigerator, a short extension member 192 shown in FIG. 4 is used.

Long extension member 190 has a length $L_1$ and short extension member 192 has a length $L_2$, and length $L_1$ is larger than length $L_2$. Long extension member 190 has a heater 191 incorporated therein, and short extension member 192 a heater 193 incorporated therein.

As shown in FIG. 2 and FIG. 4, the refrigerator attached in cylindrical portion 160 has refrigerator body 170 with the distal end positioned in helium tank 120 and spaced from contact 182 of heat transfer member 180.

As shown in FIG. 2, refrigerator body 170 having the distal end with long extension member 190 attached thereto configures a long refrigerator having a length allowing the long refrigerator to have a distal end thereof in contact with contact 182 of heat transfer member 180.

As shown in FIG. 4, refrigerator body 170 having the distal end with short extension member 192 attached thereto configures a short refrigerator having a length allowing the short refrigerator to have a distal end thereof out of contact with contact 182 of heat transfer member 180.

In the present embodiment, the refrigerator has the distal end with a surface having an expansion member 199 attached thereto. Expansion member 199 expands in response to the refrigerator having the distal end fitted in contact 182 of heat transfer member 180 and thus fills a space between contact 182 and the distal end.

In the present embodiment, expansion member 199 is a wire formed of indium. Specifically, the wire of indium is wound on an end of extension member 190 that serves as the distal end of the refrigerator.

Note that expansion member 199 is not limited in material to indium and may be lead or a similar material providing large expansion and having large thermal conductivity. Furthermore, expansion member 199 is geometrically not limited to wire, and it may be a sheet.

Superconducting magnet 100 thus configured is cooled in a method, as will be described hereafter. Superconducting magnet 100 is cooled in two states: superconducting coil 110 is initially cooled from a room temperature to a cryogenic temperature of about 4 K (hereinafter also referred to as initial cooling), and thereafter, superconducting coil 110 is cooled to be held at cryogenic temperature (hereinafter also referred to as steady cooling).

Figure 5:
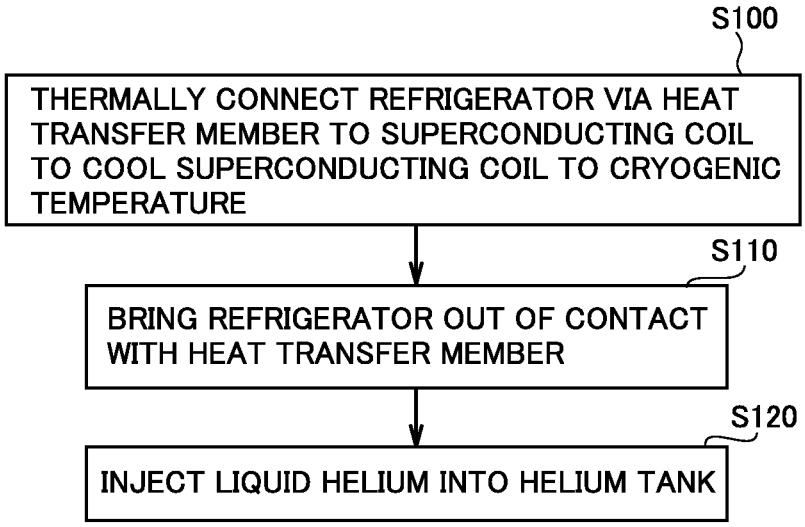
FIG. 5 is a flow chart of a method for cooling the superconducting magnet according to the same embodiment.

FIG. 5 is a flow chart of a method for cooling the superconducting magnet according to the present embodiment. As shown in FIGS. 1, 2 and 5, in the present embodiment, superconducting magnet 100 is cooled in the method, as follows: in the initially cooling, the refrigerator has the distal end brought into contact with contact 182 of heat transfer member 180 and the refrigerator is thus thermally connected via heat transfer member 180 to superconducting coil 110 to thus cool superconducting coil 110 to cryogenic temperature (S100).

Specifically, as shown in FIG. 1 and FIG. 2, in the initially cooling, the above described long refrigerator is inserted into cylindrical portion 160 and secured to vacuum vessel 150. A gasket 168 is provided between the long refrigerator and vacuum vessel 150 for vacuum. Gasket 168 for vacuum prevents helium tank 120 from receiving air externally flowing thereinto.

When the long refrigerator's distal end is fitted to contact 182 of heat transfer member 180, expansion member 199 is squashed between long extension member 190 and contact 182 and thus expands therebetween. As a result, expansion member 199 fills a space between the long refrigerator's distal end and contact 182 of heat transfer member 180 to allow them to be in thermally close contact with each other.

The refrigerator body 170 thus has second cooling stage 172 thermally connected to heat transfer member 180 via heat transfer member 180 and expansion member 199. In that condition, vacuum vessel 150 is vacuumed and helium tank 120 is filled with helium gas, and the refrigerator is then started to operate.

The initially cooling is completed once superconducting coil 110 has been cooled to cryogenic temperature via the refrigerator's distal end through heat transfer member 180. Once the initial cooling has been completed, the initial cooling is shifted to the steady cooling. In shifting to the steady cooling, initially, helium tank 120 is internally filled with one atmosphere of helium gas and the long refrigerator is subsequently removed from vacuum vessel 150.

Then, as shown in FIG. 3 and FIG. 4, long extension member 190 is replaced with short extension member 192 and short extension member 192 is attached to refrigerator body 170 to configure the short refrigerator. The short refrigerator is inserted into cylindrical portion 160 and secured to vacuum vessel 150. In doing so, gasket 168 for vacuum is replaced with a gasket 169 for internal pressure, and gasket 169 for internal pressure is disposed between the short refrigerator and vacuum vessel 150. Gasket 169 for internal pressure prevents helium tank 120 from having its internal helium gas flowing out thereof.

The short refrigerator secured to vacuum vessel 150 has the distal end out of contact with contact 182 of heat transfer member 180 and thus spaced therefrom. Thus after the initial cooling (S100) the refrigerator has the distal end out of contact with contact 182 of heat transfer member 180 (S110). This thermally disconnects the refrigerator from heat transfer member 180.

Thereafter, operating the refrigerator is resumed and valve 162 is opened to inject liquid helium 130 through piping 161 into helium tank 120 (S120). Liquid helium 130 is injected into helium tank 120 until the former is stored in the latter to attain a prescribed amount as measured with a level indicator (not shown). Once injecting liquid helium 130 has been completed, valve 162 is closed.

Thus after the initial cooling has been shifted to the steady cooling, helium volatilized in helium tank 120 is cooled by the refrigerator and thus again liquefied. As a consequence, liquid helium 130 continues to cool superconducting coil 110 and thus holds it at cryogenic temperature.

Note that, as has been discussed above, in the steady cooling, the cryostat has heat intrusion in an amount of 0.6 W, whereas the refrigerator's refrigeration capacity is 1 W and thus has an excess of 0.4 W. When the refrigerator has an excessive refrigeration capacity continuously, helium tank 120 has its internal helium gas liquefied more than necessary and thus has an internal pressure lower than one atmosphere. This is unpreferable as it would help external air to enter helium tank 120. Accordingly, in the present embodiment, heater 193 of short extension member 192 is powered with a power of 0.4 W to maintain a pressure in helium tank 120 constantly.

Thus in the present embodiment superconducting magnet 100 is cooled in a method such that before liquid helium 130 is injected into helium tank 120 the refrigerator has the distal end out of contact with contact 182 of heat transfer member 180 so that if in the steady cooling the refrigerator is stopped superconducting coil 110 can nonetheless be steadily prevented from having heat intrusion via the refrigerator.

Hereafter will be described a method for cooling a superconducting magnet and the superconducting magnet according to a second embodiment of the present invention. Note that the superconducting magnet of the present embodiment is different from superconducting magnet 100 of the first embodiment only in how the refrigerator is configured, and accordingly, the remainder in configuration of the superconducting magnet of the present embodiment will not be described.

Second Embodiment

Figure 6:
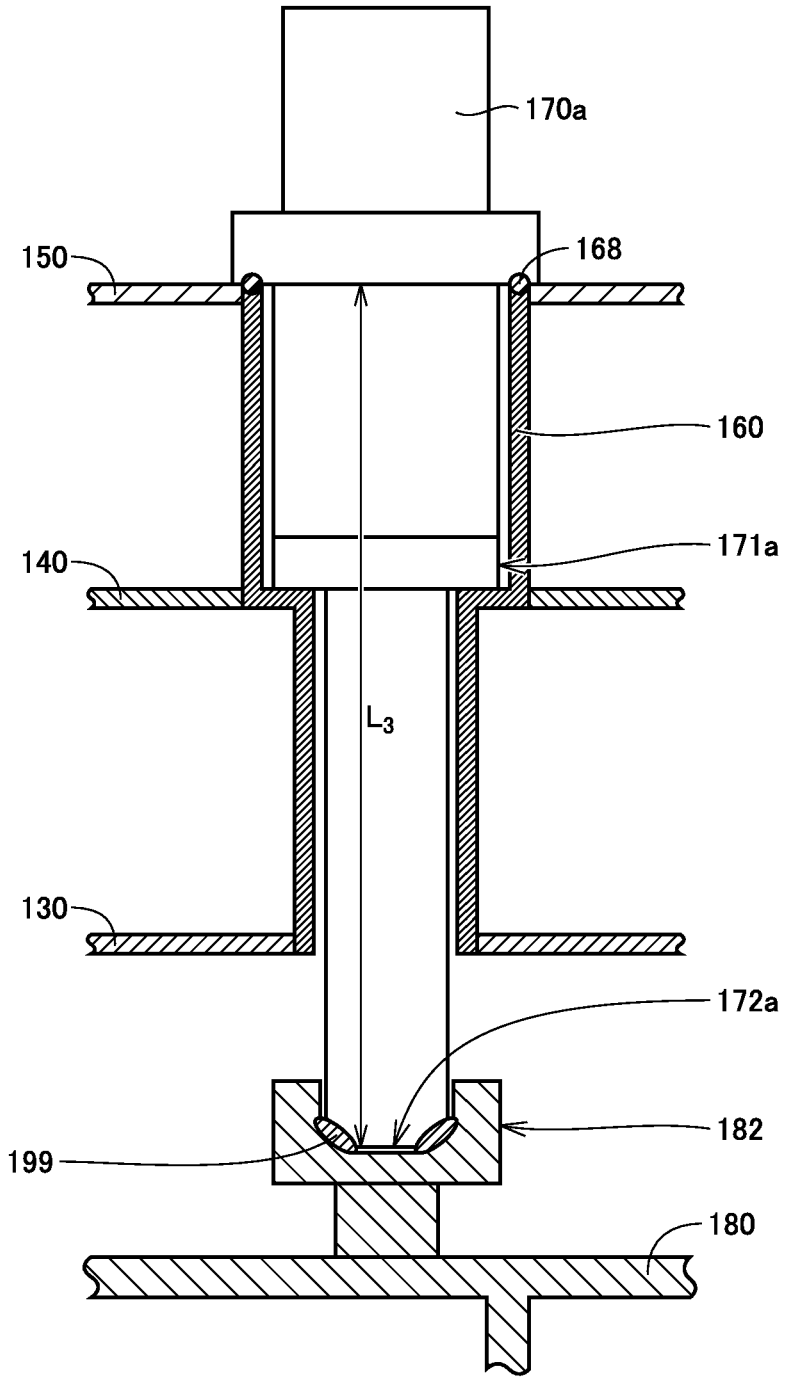
FIG. 6 shows in cross section a refrigerator in a superconducting magnet according to a second embodiment of the present invention in an enlarged view when the superconducting magnet has a superconducting coil cooled to cryogenic temperature.
Figure 7:
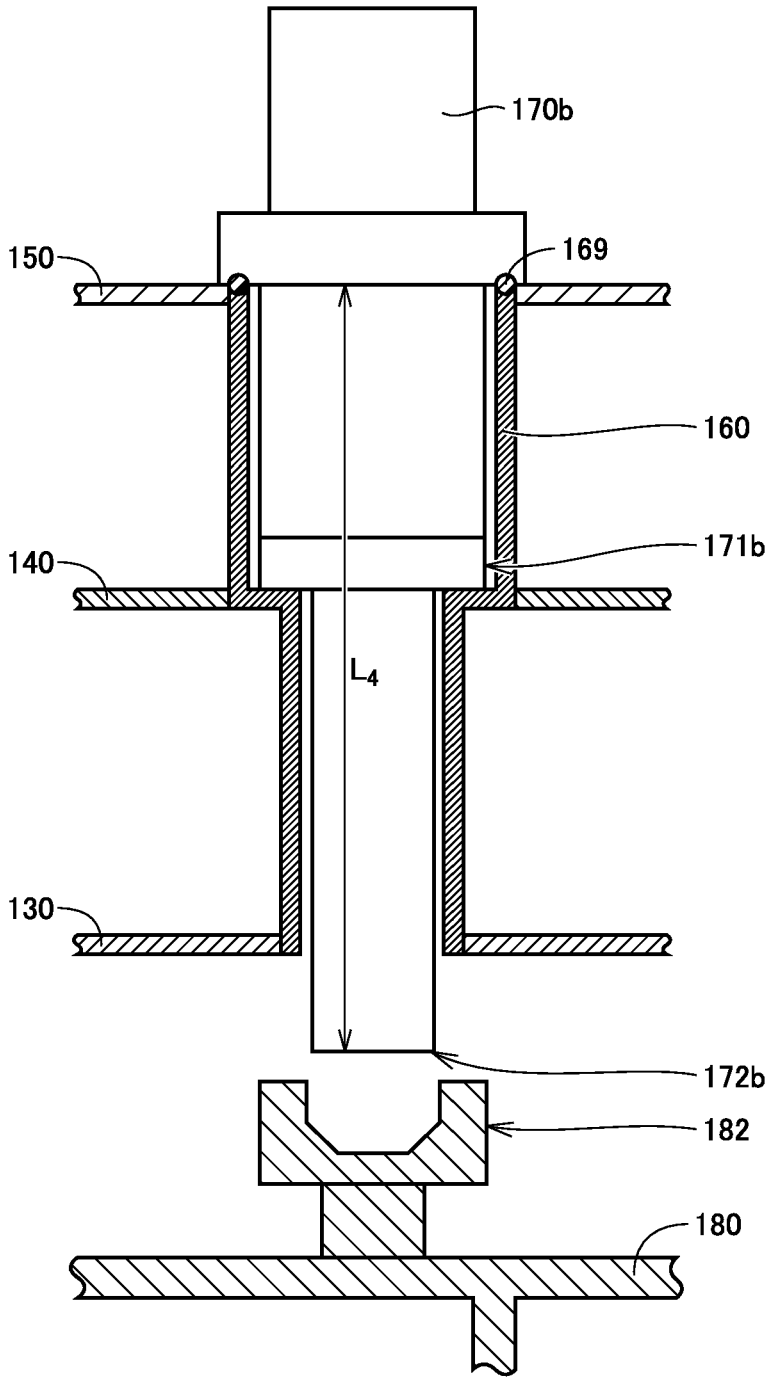
FIG. 7 shows in cross section the refrigerator in the superconducting magnet according to the same embodiment in an enlarged view when the superconducting coil has been cooled by the refrigerator and liquid helium is injected.

FIG. 6 shows in cross section a refrigerator in a superconducting magnet according to the second embodiment of the present invention in an enlarged view when the superconducting magnet has a superconducting coil cooled to cryogenic temperature. FIG. 7 shows in cross section the refrigerator in the superconducting magnet according to the present embodiment in an enlarged view when the superconducting coil has been cooled by the refrigerator and liquid helium is injected.

In the present embodiment, the extension member is not used, and two refrigerator bodies different in length and refrigeration capacity are selectively used. More specifically, the refrigerator is implemented as a long refrigerator 170*a* and a short refrigerator 170*b* used selectively, long refrigerator 170*a* having a larger refrigeration capacity than short refrigerator 170*b*.

Specifically, when superconducting coil 110 is cooled to cryogenic temperature, long refrigerator 170*a* shown in FIG. 6 is used, and once superconducting coil 110 has been cooled by the refrigerator, short refrigerator 170*b* shown in FIG. 7 is used.

Long refrigerator 170*a* has a first cooling stage 171*a* and a second cooling stage 172*a*. Short refrigerator 170*b* has a first cooling stage 171*b* and a second cooling stage 172*b*.

Long refrigerator 170*a* has a refrigeration capacity of 1.5 W for a temperature of 4 K, and short refrigerator 170*b* has a refrigeration capacity of 1 W for the temperature of 4 K. Furthermore, long refrigerator 170*a* and short refrigerator 170*b* are each configured to have an output adjustably.

In vacuum vessel 150, long refrigerator 170*a* has a length $L_3$ and short refrigerator 170*b* has a length $L_4$, length $L_3$ being larger than length $L_4$. As shown in FIG. 6, long refrigerator 170*a* has a length allowing long refrigerator 170*a* to have a distal end thereof in contact with contact 182 of heat transfer member 180. As shown in FIG. 7, short refrigerator 170*b* has a length allowing short refrigerator 170*b* to have a distal end thereof out of contact with contact 182 of heat transfer member 180.

In the present embodiment, expansion member 199 is wound on the distal end of long refrigerator 170*a*. Expansion member 199 expands in response to long refrigerator 170*a* having the distal end fitted in contact 182 of heat transfer member 180 and thus fills a space between contact 182 and the distal end of long refrigerator 170*a*.

Thus the initial cooling can be done with long refrigerator 170*a* of a large refrigeration capacity to cool superconducting coil 110 in a reduced initial cooling time. Furthermore, the steady cooling can be done with short refrigerator 170*b* of a relatively small refrigeration capacity to reduce a cost of superconducting magnet 100 shipped after the initial cooling.

Furthermore, long refrigerator 170*a* and short refrigerator 170*b* that are each configured to have an output adjustably, allow the steady cooling to be done without using a heater and instead by adjusting the output of short refrigerator 170*b* to maintain the pressure in helium tank 120 constantly.

It should be understood that the embodiments disclosed herein are illustrative and non-restrictive in any respect. Accordingly the scope of the present invention is not construed only through the above embodiments; rather, it is defined by the claims. Furthermore, it also encompasses any modifications within the scope and meaning equivalent to the terms of the claims.

REFERENCE SIGNS LIST

100: superconducting magnet; 110: superconducting coil; 120: helium tank; 130: liquid helium; 140: heat shield; 150: vacuum vessel; 160: cylindrical portion; 161: piping; 162: valve; 168, 169: gasket; 170: refrigerator body; 170*a*: long refrigerator; 170*b*: short refrigerator; 171: first cooling stage; 172: second cooling stage; 180: heat transfer member; 181: connection; 182: contact; 190, 192: extension member; 191, 193: heater; 199: expansion member.

The invention claimed is:

1. A method for cooling a superconducting magnet including:

a helium tank provided to store liquid helium therein;

a superconducting coil accommodated in said helium tank and immersed in said liquid helium;

a vacuum vessel having said helium tank accommodated therein;

a refrigerator detachably secured to said vacuum vessel and having a distal end in said helium tank; and a heat transfer member located in said helium tank and thermally connected to said superconducting coil in contact therewith, and having a contact allowed to contact said distal end of said refrigerator, said refrigerator including a long refrigerator having a length allowing said distal end to be in contact with said contact of said heat transfer member, and a short refrigerator having a length allowing said distal end to be out of contact with said contact of said heat transfer member, the method comprising the steps of:

attaching said long refrigerator to said vacuum vessel and bringing said distal end of said long refrigerator into contact with said contact of said heat transfer member to thermally connect said long refrigerator via said heat transfer member to said superconducting coil to cool said superconducting coil to cryogenic temperature;

after the step of attaching said long refrigerator to said vacuum vessel, attaching said short refrigerator to said vacuum vessel and bringing said distal end of any of said refrigerators located in said helium tank out of contact with said contact of said heat transfer member; and after the step of attaching said short refrigerator to said vacuum vessel, injecting said liquid helium into said helium tank and cooling helium that is vaporized in said helium tank by said short refrigerator to thus again liquefy the helium to allow said liquid helium to continue to cool said superconducting coil to maintain said superconducting coil at cryogenic temperature.

2. The method for cooling a superconducting magnet according to claim 1, wherein said long refrigerator used in the step of attaching said long refrigerator to said vacuum vessel has a larger refrigeration capacity than a said short refrigerator used in the step of attaching said short refrigerator to said vacuum vessel.

3. The method for cooling a superconducting magnet according to claim 1, wherein:

said heat transfer member has said contact shaped to be fittable to said distal end of said refrigerator;

said refrigerator further has an expansion member attached to a surface of said distal end; and in the step of attaching said long refrigerator to said vacuum vessel, said expansion member expands in response to said refrigerator having said distal end fitted in said contact of said heat transfer member and thus fills a space between said contact and said distal end.

4. A superconducting magnet comprising:

a helium tank provided to store liquid helium therein;

a superconducting coil accommodated in said helium tank and immersed in said liquid helium;

a vacuum vessel having said helium tank accommodated therein;

a cylindrical portion extending from said vacuum vessel to said helium tank to allow communication between outside of said vacuum vessel and an interior of said helium tank;

a refrigerator inserted in said cylindrical portion and detachably secured to said vacuum vessel, and having a distal end in said helium tank; and a heat transfer member located in said helium tank and thermally connected to said superconducting coil in contact therewith, said heat transfer member having a contact located under said cylindrical portion and allowed to contact said distal end of said refrigerator, said refrigerator including a long refrigerator having a length allowing said distal end to be in contact with said contact of said heat transfer member, and a short refrigerator having a length allowing said distal end to be out of contact with said contact of said heat transfer member, wherein:

while said superconducting coil is being cooled to reach cryogenic temperature, said long refrigerator is inserted in said cylindrical portion and attached to said vacuum vessel, and said long refrigerator has said distal end in contact with said contact of said heat transfer member and is thus thermally connected to said superconducting coil via said heat transfer member; and while said superconducting coil is held cooled at cryogenic temperature, said short refrigerator is inserted in said cylindrical portion and attached to said vacuum vessel, and any of said refrigerators located in said helium tank has said distal end out of contact with said contact of said heat transfer member and helium vaporized in said helium tank is cooled by said short refrigerator and thus again liquefied to allow said liquid helium to continue to cool said superconducting coil to maintain said superconducting coil at cryogenic temperature.

5. The superconducting magnet according to claim 4, wherein said heat transfer member has said contact shaped to be fittable to said distal end of said refrigerator.

6. The superconducting magnet according to claim 5, wherein:

said refrigerator further has an expansion member attached to a surface of said distal end; and said expansion member expands in response to said refrigerator having said distal end fitted in said contact of said heat transfer member and thus fills a space between said contact and said distal end.

* * * * *